US008155496B1

(12) United States Patent
Cumberland et al.

(10) Patent No.: US 8,155,496 B1
(45) **Date of Patent: *Apr. 10, 2012**

(54) COMPOSITE TRUSS ARMOR

(75) Inventors: Robert W. Cumberland, Malibu, CA (US); Alan J. Jacobsen, Los Angeles, CA (US); Adam F. Gross, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 403 days.

This patent is subject to a terminal disclaimer.

(21) Appl. No.: 12/476,201

(22) Filed: Jun. 1, 2009

(51) Int. Cl.
*G02B 6/00* (2006.01)

(52) U.S. Cl. ..... 385/147

(58) Field of Classification Search ..... None
See application file for complete search history.

(56) References Cited

U.S. PATENT DOCUMENTS

| | | | | |
|---|---|---|---|---|
| 3,977,294 | A | 8/1976 | Jahn | |
| 4,030,427 | A | 6/1977 | Goldstein | |
| 4,309,487 | A | 1/1982 | Holmes | |
| 4,604,249 | A | 8/1986 | Luhleich et al. | |
| 4,876,941 | A | 10/1989 | Barnes et al. | |
| 5,114,772 | A | 5/1992 | Vives et al. | |
| 5,221,807 | A | 6/1993 | Vives | |
| 5,306,557 | A | 4/1994 | Madison | |
| 5,361,678 | A | 11/1994 | Roopchand et al. | |
| 5,372,978 | A | 12/1994 | Ezis | |
| 5,654,518 | A | 8/1997 | Dobbs | |
| 5,763,813 | A | 6/1998 | Cohen et al. | |
| 6,112,635 | A | 9/2000 | Cohen | |
| 6,289,781 | B1 | 9/2001 | Cohen | |
| 6,480,734 | B1 | 11/2002 | Zhang et al. | |
| 6,575,075 | B2 | 6/2003 | Cohen | |
| 6,609,452 | B1 | 8/2003 | McCormick et al. | |
| 6,955,112 | B1 | 10/2005 | Adams et al. | |
| 7,069,836 | B1 | 7/2006 | Palicka et al. | |
| 7,117,780 | B2 | 10/2006 | Cohen | |
| 7,382,959 | B1 | 6/2008 | Jacobsen | |
| 7,653,276 | B1 * | 1/2010 | Gross et al. | 385/46 |
| 7,687,132 | B1 * | 3/2010 | Gross et al. | 428/116 |
| 7,938,989 | B1 * | 5/2011 | Gross et al. | 264/1.27 |
| 2002/0012768 | A1 | 1/2002 | Cohen | |
| 2005/0072294 | A1 | 4/2005 | Cohen | |
| 2006/0105184 | A1 | 5/2006 | Palicka et al. | |
| 2006/0137517 | A1 | 6/2006 | Palicka et al. | |
| 2006/0225180 | A1 | 10/2006 | Ben-Simhon | |
| 2006/0234577 | A1 | 10/2006 | Wagner et al. | |
| 2010/0159294 | A1 * | 6/2010 | Fly et al. | 429/12 |

* cited by examiner

*Primary Examiner* — Sung Pak
(74) *Attorney, Agent, or Firm* — Christie, Parker, Hale

(57) ABSTRACT

A composite truss armor and a method of manufacturing the same. The composite truss armor includes a filler material and a three-dimensional (3D) ordered truss structure. The 3D ordered truss structure includes: a plurality of first truss elements defined by a plurality of first self-propagating polymer waveguides and extending along a first direction; a plurality of second truss elements defined by a plurality of second self-propagating polymer waveguides and extending along a second direction; and a plurality of third truss elements defined by a plurality of third self-propagating polymer waveguides and extending along a third direction. The first, second, and third ordered truss elements interpenetrate each other at a plurality of nodes to form a continuous material. The first, second, and third truss elements define an open space. The filler material occupies at least a portion of the open space, and the 3D ordered truss structure is self-supporting.

11 Claims, 12 Drawing Sheets

COMPOSITE TRUSS ARMOR

FIELD OF THE INVENTION

The present invention relates to a micro-truss based composite armor (or composite truss armor) and a method and/or system of manufacturing the same.

BACKGROUND OF THE INVENTION

Standard flexible body armors (a.k.a. "bullet proof" vests) are commonly used by police officers throughout the United States. However, these vests are incapable of defeating the ballistic threats imposed by military pattern rifles firing high-velocity, armor-piercing (AP) projectiles. As these threats are frequently encountered during wartime, the US military has adopted body armor with pockets which can accommodate hard ballistic trauma plate inserts, which can defeat AP rifle fire. The National Institute of Justice (NIJ) classifies AP rifle fire as threat level IV, and any ballistic armor plate certified to defeat a level IV threat must be capable of stopping projectiles up to and including AP 7.62×63 mm (30-06). Current state of the art level IV trauma plates are manufactured from laminate metal ceramic composites, and usually measure a minimum of 0.7" thick. A typical level IV plate measuring 10"×12"×0.7" weighs about 8 pounds and has a relatively high cost (e.g., about $300). Similarly constructed ceramic composites are also used for armor military vehicles.

Current ceramic composite armor plating has several issues that should be ameliorated:

(1) Weight: Soldiers are often overburdened by the additional weight of these plates, and are forced to forgo the additional protection in order to carry other gear. Additionally, the weight reduces the maximum size of the plates a soldier can carry and leaves unprotected areas on a soldier's body.

(2) Bulk: The bulkiness of the plate inserts makes them visible to the enemy, allowing enemy soldiers to shoot around the plates hitting more vulnerable areas.

(3) Overheating: The heat trapping properties of trauma plates make them uncomfortable to wear in hot, desert climates. Therefore, the existence of a lightweight, lower profile, breathable Level IV trauma plate would be of great interest to the US armed forces.

(4) Thermal attack: Ceramic armor plates are not designed to defend against thermal or directed energy attacks. The two (2)-dimensional nature of the current laminated construction provides poor thermal conductivity, allowing hot spots to develop in the event of a thermal attack.

(5) Damage resistance: Once an armor plate is hit it usually breaks in pieces and does not continue to defend against impacts.

US Patent Publication No. 20060234577, which is incorporated by reference herein in its entirety, describes a type of body armor constructed from a fabric impregnated with a shear thickening fluid. An advantage of the armor described in this patent application is that it remains flexible until struck, but this armor is not designed to compete with currently available hard armor plate inserts (so called level III or higher trauma plates) but rather to replace current flexible body armors. As such, this patent application does not provide for non-flexible armors (suitable for trauma plates).

US Patent Publication No. 20060225180, which is incorporated by reference herein in its entirety, describes a type of reactive armor utilizing gas pressure to actively repel incoming threats, unlike the non-flexible armors described above which are of the passive type.

US Patent Publication Nos. 200060137517 and 20060105184 and U.S. Pat. No. 7,069,836, which are incorporated by reference herein in their entirety, describe a type of metal/ceramic armor which is constructed with metallic plates and ceramic fillers. However, these patent disclosures do not provide for an ordered, three (3)-dimensional component as discussed in more detail below.

US Patent Publication Nos. 20050072294 and 20020012768 and U.S. Pat. Nos. 7,117,780, 6,575,075, 6,480,734, 6,289,781, 6,112,635, 5,763,813, 5,361,678, which are incorporated by reference herein in their entirety, describe a type of ceramic armor wherein close packed pellets of a hard ceramic phase are surrounded with an elastic (tough) material. While the pellets are closely packed together and form a regular, 3-dimensional repeating pattern, they do not provide for a continuous truss like structure.

U.S. Pat. No. 6,955,112, which is incorporated by reference herein in its entirety, describes a type of composite armor based on a ceramic fibrous or foam-like structure infused with liquid metal. However, this patent does not provide for using an ordered framework.

U.S. Pat. Nos. 6,609,452, 5,372,978, and 4,604,249, which are incorporated by reference herein in their entirety, describe the manufacture of ballistic armor plates composed of a porous SiC infiltrated with various metals (e.g. steel). None of these patents provide for the concept of utilizing SiC in an organized, framework or other similar type structure.

U.S. Pat. No. 5,654,518, which is incorporated by reference herein in its entirety, describes the construction of a "double truss structural armor". This armor is constructed by laminating corrugated ceramic and metallic layers. As such, the structure disclosed in this patent disclosure is not a continuous 3-dimensional structure.

U.S. Pat. Nos. 5,306,557, 5,114,772, 4,876,941, 4,309,487, 3,977,294, which are incorporated by reference herein in their entirety, describe the construction of hard armor plates composed of laminated/multilayered ceramics, metals, polymers and/or carbon fiber sheets. However, these structures are not 3-dimensional structures.

U.S. Pat. No. 4,030,427, which is incorporated by reference herein in its entirety, describes a type of armor plate formed by dispersing titanium carbide (ceramic) particles throughout a tough titanium-nickel alloy. Because the ceramic particles are randomly distributed throughout the metallic matrix, there is no ordered 3-dimensional component to the structure disclosed in this patent.

U.S. Pat. No. 5,221,807, which is incorporated by reference herein in its entirety, describes a type of ballistic armor utilizing perforated/porous ceramic layers sandwiched in a laminated plate like structure. Again, the structure disclosed in this patent is not a 3-dimensional continuous structure.

In view of the foregoing, the above described patent disclosures describe various concepts for creating armor plate through a ceramic/metallic composite structure, but these disclosures do not provide a concept for fabricating armor from small scale 3-dimensionally ordered truss structure. That is, these patent disclosures provide ceramic phase that is either distributed as a powder, organized by virtue of stacking ceramic balls/pellets, or laminated as alternating ceramic and metallic plates. As such, there is a need for an armor that incorporates ceramic and metallic continuous phases, interwoven and repeating with both long range and short range order.

SUMMARY OF THE INVENTION

An aspect of an embodiment of the present invention is directed toward a method and/or system of fabricating armor from small scale 3-dimensionally ordered truss structure. An armor according to an embodiment of the present invention incorporates ceramic and metallic continuous phases, interwoven and repeating with both long range and short range order.

Aspects of embodiments of the present invention are directed toward a micro-truss based composite armor also referred to as composite truss armor (CTAr) having a three-dimensional ordered microstructure and a method and/or system of creating the same. Here, in one or more aspects of embodiments of the present invention, the CTAr has both long range and short range order, and/or is a type of composite armor that contains a small scale truss-like framework, which can defend against directed energy, thermal, and/or ballistic threats. In one aspect, unlike armor plates (trauma plates) that consist, of alternating layers composed of ceramic and metallic sheets, an embodiment of the invention provides an armor wherein the ceramic and metallic phases exist as interwoven (interpenetrating), continuous 3-dimensional networks.

An embodiment of the present invention provides a composite truss armor that includes an armor filler material and a three-dimensional ordered truss structure. The three-dimensional ordered truss structure includes: a plurality of first truss elements defined by a plurality of first self-propagating polymer waveguides and extending along a first direction; a plurality of second truss elements defined by a plurality of second self-propagating polymer waveguides and extending along a second direction; and a plurality of third truss elements defined by a plurality of third self-propagating polymer waveguides and extending along a third direction. The first, second and third ordered truss elements are coupled at a plurality of nodes unperturbed by changes in index of refraction caused by photopolymerization of the first, second and third self-propagating polymer waveguides and defined by waveguide intersections of the first, second and third self-propagating polymer waveguides. The first, second, and third ordered truss elements interpenetrate each other at the plurality of nodes to form a continuous material. The first, second, and third truss elements define an open space. The armor filler material occupies at least a portion of the open space, and the three-dimensional ordered truss structure is self-supporting.

In one embodiment, the three-dimensional ordered truss structure has a sold volume friction of not less than about 2% and not greater than about 90%.

In one embodiment, the open space of the three-dimensional ordered truss structure is partially filled with the armor filler material such that the composite truss armor is a breathable structure.

In one embodiment, the open space of the three-dimensional ordered truss structure is completely filled with the armor filler material such that the composite truss armor is a solid armor plate.

In one embodiment, the three-dimensional ordered truss structure is a ceramic three-dimensional ordered truss structure, and the armor filler material is a metallic filler material.

In one embodiment, the three-dimensional ordered truss structure is a metallic three-dimensional ordered truss structure, and the armor filler material is a ceramic filler material.

In one embodiment, the three-dimensional ordered truss structure includes a material selected from diamond like carbon (DLC), $B_6O$, BN, BCN, SiC, $Si_3N_4$ or any other similar high hardness and/or incompressible metal oxide, nitride, carbide, or boride (e.g. $Al_2O_3$, WC, TiN, $TiB_2$, $ReB_2$, etc.), or combinations thereof, and the armor filler material includes a material selected from Al, Ti, Fe, Co, Ni, W, U, steel, and alloys thereof.

In one embodiment, the three-dimensional ordered truss structure includes a material selected from Al, Ti, Fe, Co, Ni, W, U, steel, and alloys thereof, and the armor filler material includes a material selected from diamond like carbon (DLC), $B_6O$, BN, BCN, SiC, $Si_3N_4$ or any other similar high hardness and/or incompressible metal oxide, nitride, carbide, or boride (e.g. $Al_2O_3$, WC, TiN, $TiB_2$, $ReB_2$, etc.), or combinations thereof.

In one embodiment, the three-dimensional ordered truss structure is a carbon three-dimensional ordered structure with one or more metal and/or ceramic layers coating a surface of at least one truss element of the first truss elements, the second truss elements, or the third truss elements.

In one embodiment, the three-dimensional ordered truss structure and the armor filler material include ceramic and metallic material components for providing thermal conductivity throughout the composite truss armor to provide protection against thermal/directed energy/heat based attacks.

In one embodiment, the three-dimensional ordered truss structure and the armor filler material are configured to be a personnel body armor, machinery armor, a safe door and/or vault armor, and/or a protection armor against thermal/directed energy/heat based attacks.

Another embodiment of the present invention provides a composite truss armor that includes: a first face plate; a second face plate; and a truss-like core between the first face plate and the second face plate. The truss-like core includes a plurality of truss elements for guiding projectiles into specific desired locations of the composite truss armor, the specific desired locations being reinforced with additional materials.

In one embodiment, the composite truss armor further includes a plurality of mounting blocks for mounting at least one of the first plate or the second plate to a vehicle or aircraft frame, wherein the projectiles are guided by the plurality of truss elements of the truss-like core to the mounting blocks.

In one embodiment, the plurality of truss elements of the truss-like core are configured to be a plurality of V-shaped structures for guiding projectiles into the specific desired locations.

In one embodiment, at least one of the first face plate or the second face plate includes an armor filler material and a three-dimensional ordered truss structure. The three-dimensional ordered truss structure includes: a plurality of first truss elements defined by a plurality of first self-propagating polymer waveguides and extending along a first direction; a plurality of second truss elements defined by a plurality of second self-propagating polymer waveguides and extending along a second direction; and a plurality of third truss elements defined by a plurality of third self-propagating polymer waveguides and extending along a third direction. The first, second, and third ordered truss elements interpenetrate each other at a plurality of nodes to form a continuous material. The first, second, and third truss elements define an open space. The armor filler material occupies at least a portion of the open space, and the three-dimensional ordered truss structure is self-supporting.

In one embodiment, the first and second face plates are asymmetrical to each other in thickness and/or material.

According to another embodiment of the present invention, a method of forming a composite truss armor includes: securing a volume of a photo-monomer; securing a mask between at least one collimated light source and the volume of the photo-monomer, the mask having a plurality of apertures; directing a collimated light beam from the at least one collimated light source to the mask for a period of exposure time so that a portion of the collimated light beam passes through the mask and is guided by the plurality of apertures into the photo-monomer to form a plurality of waveguides through a portion of the volume of the photo-monomer; removing any uncured photo-monomer to leave behind a three-dimensional ordered polymer microstructure having a plurality of polymer truss elements defined by the plurality of waveguides; forming a three-dimensional ordered armor truss structure composed of a plurality of armor truss elements defined by the plurality of polymer truss elements; and placing an armor filler material at an open space defined by the plurality of armor truss elements of the three-dimensional ordered armor truss structure.

In one embodiment, the forming of the three-dimensional ordered armor truss structure includes forming one or more ceramic layers on at least one of the plurality of polymer truss elements.

In one embodiment, the forming of the three-dimensional ordered armor truss structure includes: forming a reverse mold of the three-dimensional polymer microstructure; filling the reverse mold with a preceramic polymer or ceramic slurry; curing the preceramic polymer or ceramic slurry; and removing the reverse mold to leave behind the three-dimensional ordered armor truss structure.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
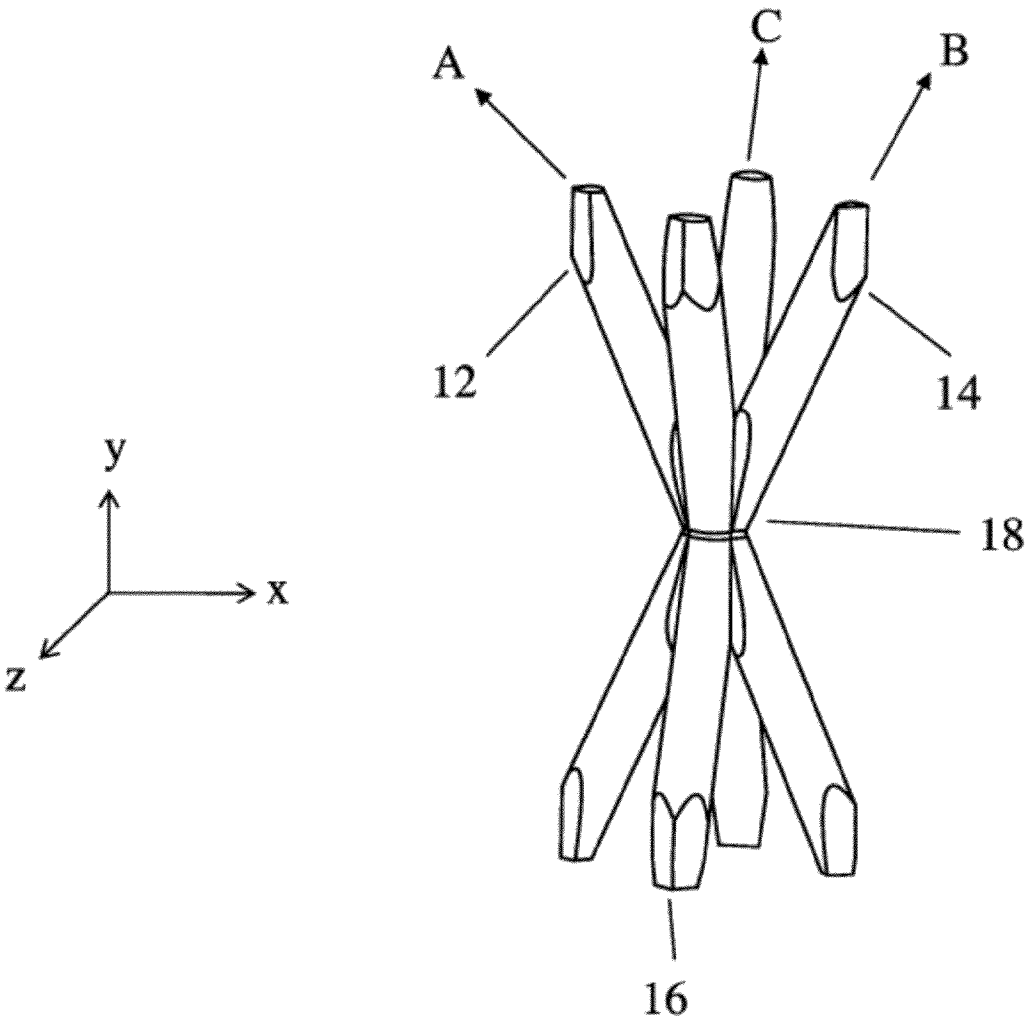
FIG. 1 is a perspective schematic view of a portion of a structure according to an embodiment of the present invention.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

In the context of embodiments of the present invention, a three-dimensional ordered microstructure is referred to as an ordered three-dimensional structure having order at the micrometer scale.

An embodiment of the present invention provides a method and/or system of fabricating armor from small scale 3-dimensionally ordered truss structure. An armor according to an embodiment of the present invention incorporates ceramic and metallic continuous phases, interwoven and repeating with both long range and short range order. To put it another way, an embodiment of the present invention provides an armor that has a ceramic phase arranged in an order scheme that is different from a ceramic phase that is either distributed as a powder, organized by virtue of stacking ceramic balls/pellets, or laminated as alternating ceramic and metallic plates.

Embodiments of the present invention are directed towards a micro-truss based composite armor also referred to as composite truss armor (CTAr) having a three-dimensional ordered microstructure and a method and/or system of creating the same. Here, as envisioned, an embodiment of the present invention, the CTAr has both long range and short range order, and/or is a type of composite armor that contains a small scale truss-like framework, which can defend against directed energy, thermal, heat, and/or ballistic threats. In one embodiment, unlike armor plates (trauma plates) that consist of alternating layers composed of ceramic and metallic sheets, an embodiment of the invention provides an armor wherein the ceramic and metallic phases exist as interwoven (interpenetrating), continuous 3-dimensional networks.

In one embodiment, a micro-truss based composite armor is a personnel body armor; machinery armor for an armored car, a tank, a plane, etc.; an armor for a safe door, a vault, etc.; and/or a protection armor against thermal/directed energy/heat based attacks.

As envisioned, embodiments of the present invention having the micro-truss based composite armors can be utilized by a variety of suitable military vehicles wherever there is a need to defeat (or defend against) ballistic and directed energy threats without a significant increase in weight. Also, embodiments of the present invention having the micro-truss based composite armors can be utilized to provide lightweight meteorite impact protection for spacecraft. Embodiments of the present invention having the micro-truss based composite armors can also be utilized as materials to manufacture lightweight armored vehicles. In addition, as envisioned, the government/military could benefit by using a micro-truss based composite armor material in the construction of trauma plate inserts for bullet proof vests and for creating bomb proof doors for homeland security.

Figure 2:
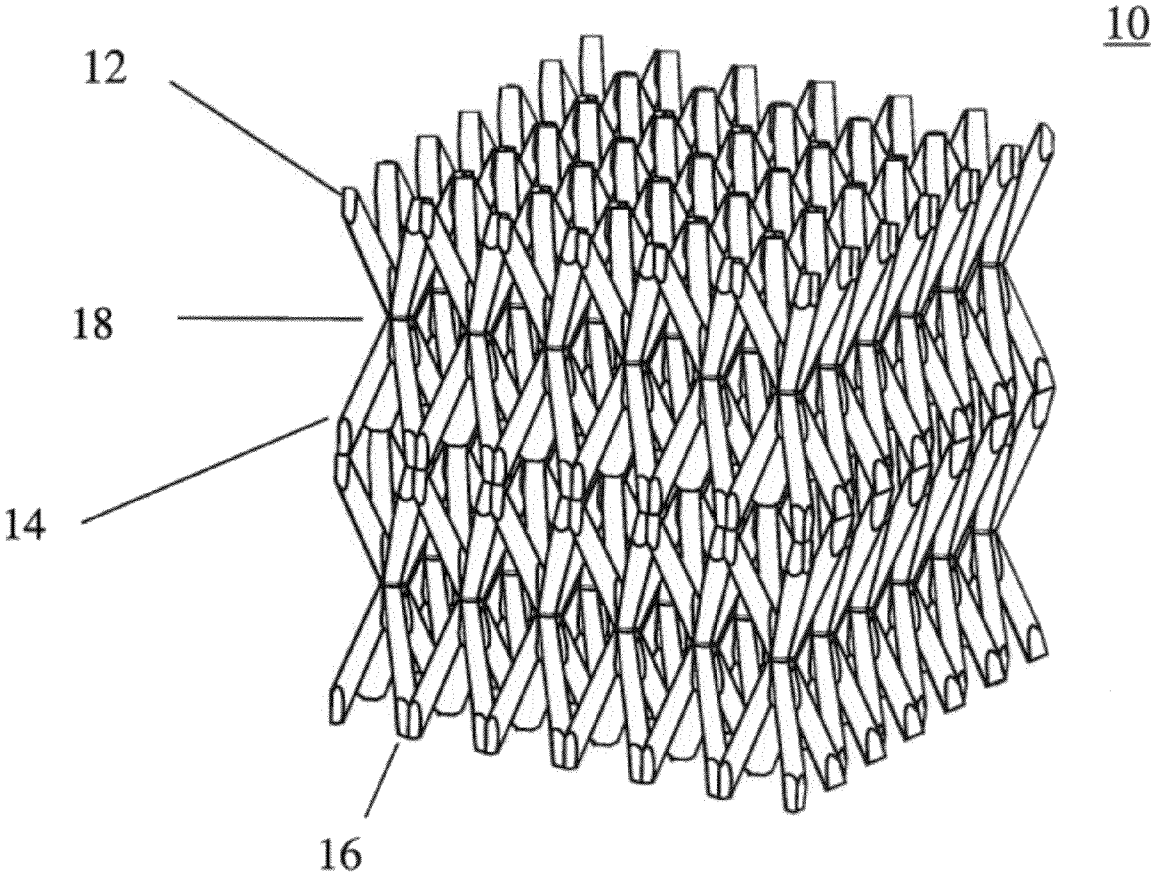
FIG. 2 is a perspective schematic view of a structure according to an embodiment of the present invention.

Referring to FIGS. 1 and 2, a three-dimensional ordered open-cellular microstructure 10 according to an embodiment of the present invention is a self-supporting structure. In one embodiment of the present invention, this three-dimensional ordered open-cellular microstructure 10 can be utilized or modified for use in a micro-truss based composite armor and/or to manufacture the micro-truss based composite armor. The microstructure 10 includes first truss elements 12, second truss elements 14, and third truss elements 16. The first truss elements 12 are defined by first self-propagating polymer waveguides and extend along a first direction A. The second truss elements 14 are defined by second self-propagating polymer waveguides and extend along a second direction B. The third truss elements 16 are defined by third self-propagating polymer waveguides and extend along a third direction C. With reference to FIGS. 1 and 2, the truss elements 12, 14, 16 interpenetrate each other at nodes 18 to form a continuous material with a three-dimensional microstructure order. Also, in one embodiment, these nodes are unperturbed by changes in index of refraction caused by photopolymerization due to their formation as described in more detail below with respect to FIG. 5.

In one embodiment, the truss elements 12, 14, 16 include a photo-polymer material. In one embodiment, the truss elements 12, 14, 16 are polymer optical waveguide truss elements.

In one embodiment, the continuous material is continuously formed such that it lacks any interior boundaries, e.g., boundaries within the interpenetrating portions of truss elements 12, 14, 16. In another embodiment, each node 18 of the microstructure 10 is formed of the continuous material.

According to one embodiment of the present invention, the microstructure 10 is formed by using a fixed light input (collimated UV light) to cure (polymerize) polymer optical waveguides, which can self-propagate in a 3D pattern. As such, the propagated polymer optical waveguides form the microstructure 10.

As disclosed in Monro et al. "Topical Review Catching Light In Its Own Trap," Journal Of Modern Optics, 2001, Vol. 48, No. 2, 191-238, which is incorporated by reference herein in its entirety, some liquid polymers, referred to as photopolymers, undergo a refractive index change during the polymerization process. The refractive index change can lead to a formation of polymer optical waveguides. If a monomer that is photo-sensitive is exposed to light (typically UV) under the right conditions, the initial area of polymerization, such as a small circular area, will "trap" the light and guide it to the tip of the polymerized region, further advancing that polymerized region. This process will continue, leading to the formation of a waveguide structure with approximately the same cross-sectional dimensions along its entire length. Here, the length of the truss elements is limited by the intensity of the light and the nature and/or material characteristics of the monomer.

According to one embodiment of the present invention, a mask with a two-dimensional pattern of apertures (see FIG. 3) is used to create a three-dimensional polymer microstructure (or an open-cellular polymer micro-truss structure).

Figure 3:
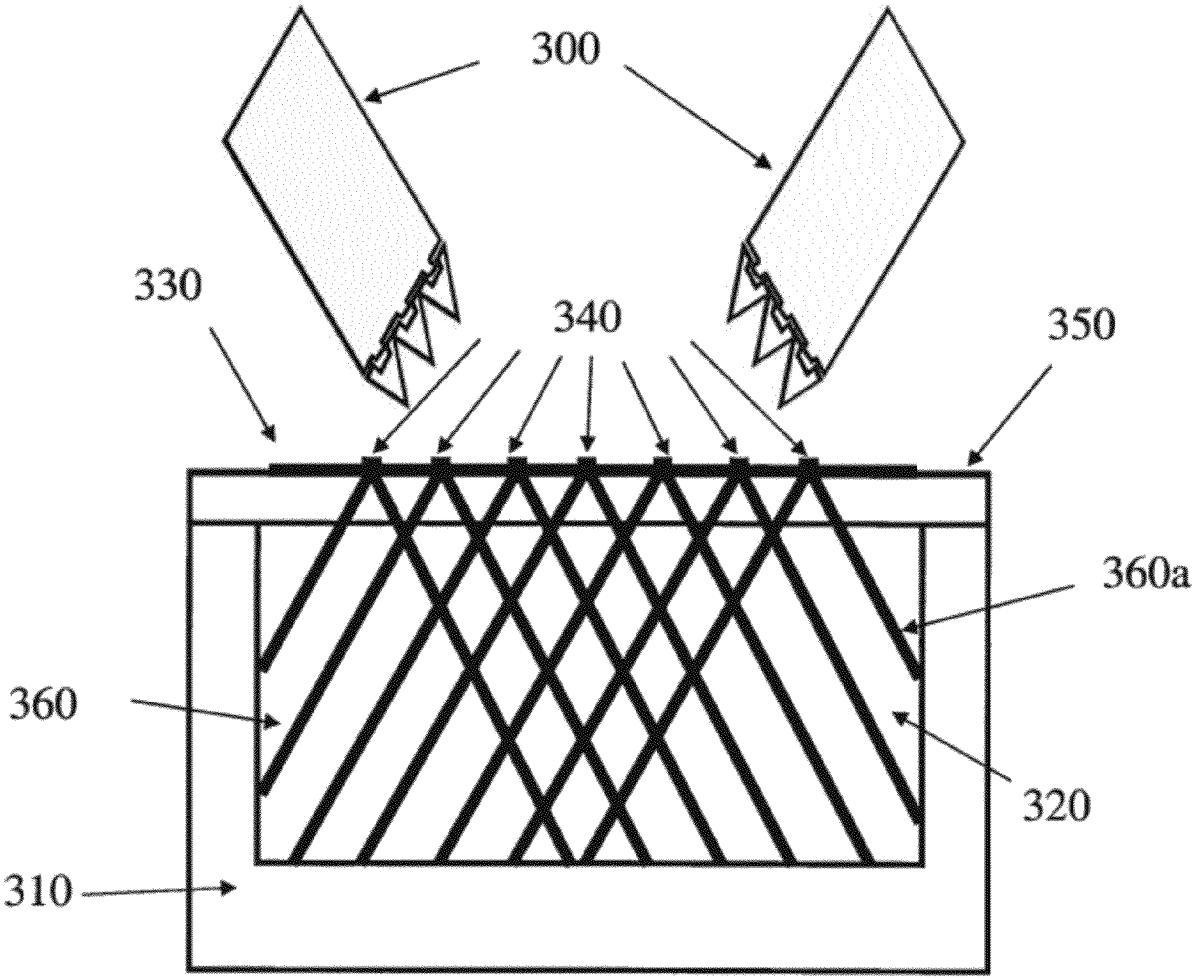
FIG. 3 is a schematic diagram of a system for forming a structure of an embodiment of the present invention from multiple waveguides created using a single collimated beam or multiple collimated beams through multiple apertures.
Figure 4B:
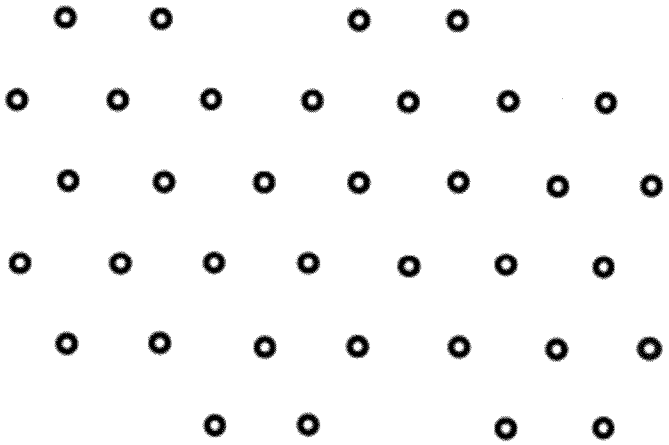
FIG. 4*b* illustrates an example of a hexagonal mask pattern (or a hexagonal mask aperture pattern) according to embodiments of the present invention.
Figure 4A:
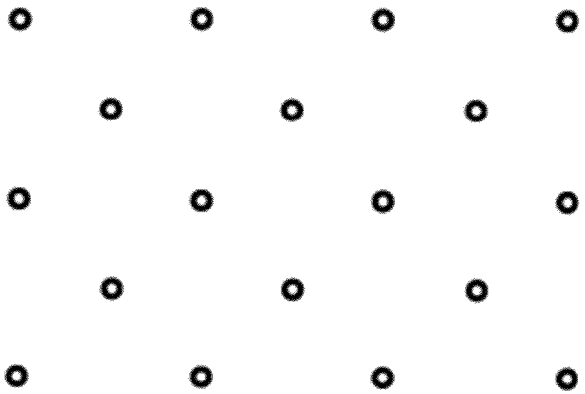
FIG. 4*a* illustrates an example of a square mask pattern (or a square mask aperture pattern) according to embodiments of the present invention.

With reference to FIG. 3, a system for forming a three-dimensional polymer microstructure according to an embodiment of the present invention includes one or more collimated light sources 300, a reservoir (mold) 310 having a volume of monomer 320 that will polymerize at a wavelength of collimated light beams provided by the light sources 300, and a patterning apparatus, such as a mask 330 with multiple apertures (open areas) 340. Each of the apertures 340 has a given shape and dimension substantially matching a cross-section geometry of a waveguide (e.g., waveguide 360*a*). Between the mask 330 and the monomer 320, there may be a substrate 350. Here, in FIG. 3, a truly 3D network can be formed because the intersecting polymer waveguides 360 will simply polymerize together, but will not interfere with waveguide propagation. Also, the spacing between the plurality of waveguides 360 corresponds with the pattern of the plurality of apertures 340. The pattern of the apertures 340 may, for example, be in a square pattern as shown in FIG. 4*a* and/or in a hexagonal pattern as shown in FIG. 4*b*. The hole (aperture) spacing, i.e., distance between apertures 340 in the mask 330, and the number of waveguides 360 formed from each of the apertures 340 will determine the open volume fraction (i.e. open space) of the formed three-dimensional ordered microstructure (or the formed open-cellular polymer micro-truss structure).

As such, through the system of FIG. 3, a three-dimensional ordered microstructure of an embodiment of the present invention can be designed for a given application. The design parameters include: 1) the angle and pattern of the polymer waveguides with respect to one another, 2) the packing, or relative density of the resulting cellular structure (or the open volume fraction), and 3) the cross-sectional shape and dimensions of the polymer waveguides. Here, in one embodiment, the waveguide (or truss) diameter can range from 10 microns to 5 mm depending on the design criteria. The length of the waveguide between waveguide nodes of interpenetrating waveguides can be between 5 and 15 times the diameter. In addition, the number of nodes, or the number of repeating unit cells, through the thickness can be designed. Typical micro-truss structures can have ½ unit cell to 5 unit cells through the thickness. Moreover, due to the method of formation of the three-dimensional ordered microstructure (or the open-cellular polymer micro-truss structure) according to an embodiment of the present invention and as described in following method shown in FIG. 5, the propagation distances and/or the nodes of the interpenetrating waveguides are unperturbed by the change in index of refraction caused by polymerization.

Figure 5:
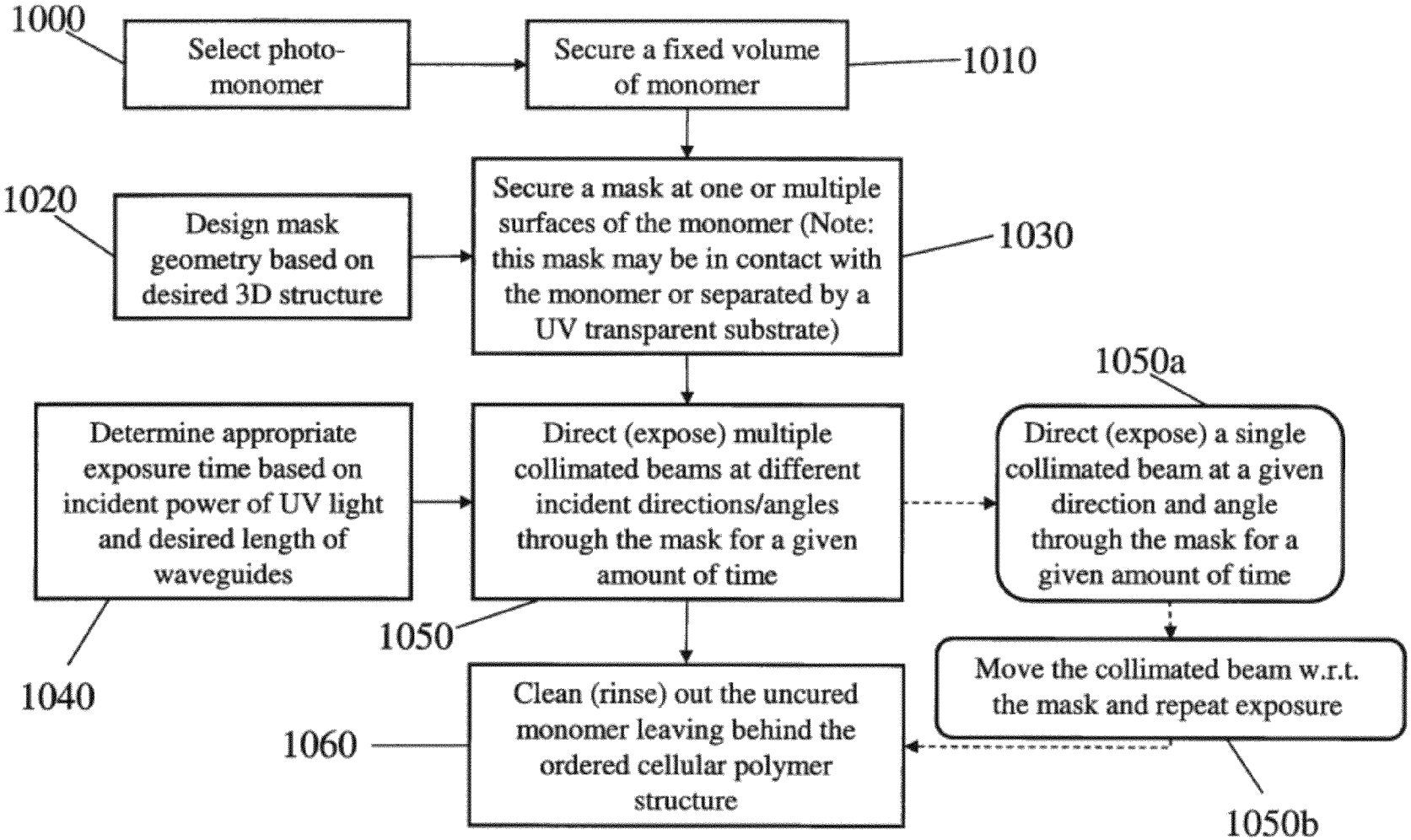
FIG. 5 is a process flow diagram for forming one or more polymer waveguides of a structure according to an embodiment of the present invention.

In more detail, FIG. 5 shows a method of forming a three-dimensional ordered microstructure (or an open-cellular polymer micro-truss structure) according to an embodiment of the present invention. As illustrated in FIG. 5, a photo-monomer is selected in block 1000. In block 1010, a volume of the selected photo-monomer is secured (e.g., in a reservoir). A mask geometry is designed based on a desired three-dimensional structure in block 1020. A patterning apparatus, such as a mask having the designed geometry, is secured in block 1030. Here, the secured mask has at least one aperture between at least one collimated light source and the volume of the selected photo-monomer. In addition, the mask may be in contact with the monomer or separated by a substrate (e.g., by a UV transparent substrate).

In block 1040, an appropriate exposure time is determined based on incident power of a collimated light beam from the at least one collimated light source (e.g., an incident power of a UV light) and a desired length of one or more waveguides. The collimated light beam from the at least one collimated light source is directed to the mask for a period of exposure time so that a portion of the collimated beam passes through the mask and is guided by the at least one aperture into the photo-monomer to form at least one waveguide through a portion of the volume of the photo-monomer. Here, the at least one waveguide has a cross-sectional geometry substantially matching the designed aperture geometry on the mask.

In one embodiment as shown in block 1050, multiple collimated beams at different incident directions and/or angles are directed through the mask for a given amount of time.

Alternatively, as shown in blocks 1050*a*, a single collimated beam at a given direction and angle is directed through the mask for a given amount of time. Then, at block 1050*b*, the collimated light beam is moved with respect to the mask and the exposure is repeated.

Then, at block 1060, any uncured photo-monomer is removed to leave behind a three-dimensional ordered polymer microstructure (or an open-cellular polymer micro-truss structure). Here, in one embodiment, the plurality of polymer waveguides are used to form the three-dimensional ordered polymer microstructure, and the three-dimensional ordered polymer microstructure corresponds with the pattern of the plurality of apertures.

The resulting three-dimensional polymer microstructure can be formed in seconds in the area where exposed to the incident collimated beam. Since the incident light and the monomer remain fixed with respect to one another during the formation of a polymer waveguide, the exposure area of the collimated beam(s) can be scanned over a larger surface area of monomer, leading to the formation of large-area structures.

As described, once the polymer cellular structure is formed in the volume of monomer, the remaining un-polymerized material (monomer) is removed leaving an open cellular polymer material that is the three-dimensional ordered microstructure (or the open-cellular polymer micro-truss structure). By way of example, a solvent that dissolves the monomer (but not the polymer) may be used to aid in the monomer removal.

With reference back to FIGS. 1 and 2, the truss elements 12, 14, 16 of the microstructure 10 define an open volume (i.e. free space) of the microstructure 10. In one embodiment, the microstructure 10 defines a free space of not less than about 40% by volume and not greater than about 99% by volume. In another embodiment, the microstructure 10 defines a free space of not less than about 70% by volume and not greater than about 95% by volume. The truss elements 12, 14, 16 intersect at the nodes 18 to form symmetrical angles in three dimensions (three orthogonal directions). The symmetrical angles relative to the xz-plane (see, FIG. 1), can measure between 0° and 90°. That is, truss elements 12, 14, 16 interpenetrate each other to form "perfect" (i.e., unperturbed) nodes: each of the truss elements 12, 14, 16 defines an angle relative to a compression surface of the microstructure 10 (e.g. a surface extending along a direction of the xz-plane), and the respective angles defined by the truss elements 12, 14, 16 are substantially equal to one another. That is, in one embodiment, these nodes are unperturbed by changes in index of refraction caused by photopolymerization due to their formation as described with respect to FIG. 5. However, embodiments of the present invention are not limited thereto.

The truss elements 12, 14, 16 have an intrinsically high strength due to their small scale. In one embodiment, each of the truss elements 12, 14, 16 has an axial diameter of not greater than about 500 μm.

In another embodiment, each of the truss elements 12, 14, 16 has an axial diameter of not greater than about 200 μm. In another embodiment, each of the truss elements 12, 14, 16 has an axial diameter of not greater than about 1 μm. The truss elements 12, 14, 16 are configured to have a correspondingly small aspect ratio (e.g., length/diameter ratio) for withstanding a bending moment. Here, each of the truss elements 12, 14, 16 has a length not greater than 100 μm such that the truss elements can better withstand a mechanical load applied to the microstructure 10. As such, the truss elements 12, 14, 16 experience little, if any, bending deformation during application of the mechanical load to the microstructure 10.

At certain size scales (e.g., the size scales described above), the strength of the truss elements is increased, which corresponds to an increased strength of the microstructure 10. In one embodiment, each of the truss elements 12, 14, 16 has molecular alignment extending along an axial direction of the truss element. As such, an anisotropic material is produced, which provides a substantial degree of stiffness and/or strength along the axial direction. In one embodiment, in a material that is composed of long molecular chains (e.g., polymers), the molecules thereof can be aligned along a direction to provide an increased degree of mechanical strength and/or stiffness along the alignment direction. In more detail, where the molecular alignments of the truss elements 12, 14, 16 extend along the corresponding axial directions, the truss elements 12, 14, 16 are configured to axially transfer a mechanical load applied to the microstructure 10.

As described above, the microstructure 10 withstands the mechanical load, e.g., via axial tension and compression of the truss elements 12, 14, 16. Molecular alignment of the truss elements 12, 14, 16 along their respective axial directions lends additional strength and/or stiffness to the truss elements 12, 14, 16 and, accordingly, also to the microstructure 10.

In one embodiment, the truss elements 12, 14, 16 are configured to provide the microstructure 10 with a stretch-dominated behavior under a compression load applied to the microstructure 10. Such stretch-dominated behavior is contrasted from the bending-dominated behavior (e.g. of randomly oriented cellular structures), as described in Ashby, "The Properties Of Foam And Lattices," Philosophical Transactions—Royal Society Of London Series A Mathematical Physical And Engineering Sciences, Vol. 364, 2006, which is incorporated by reference herein in its entirety.

In a bending-dominated structure, the elastic modulus is proportional to the square of the relative density $\rho'/\rho_s'$, where $\rho'$ is the density of the cellular material and $\rho_s'$ is the density of the solid from which it is constructed. In contrast, a stretch-dominated structure (such as microstructure 10), has a compressive elastic modulus (E) directly proportional to both the relative density thereof and the modulus ($E_s$) of the solid material portion of the microstructure 10, as expressed in equation (1) below:

$$E=E_s(\sin^4\theta)(\rho/\rho_s) \quad (1)$$

where $\rho$ is a density of the microstructure 10, $\rho_s$ is a density of a solid material portion of the microstructure 10, $\theta$ is an angle of at least one of the truss elements 12, 14, 16 relative to a compression surface of the microstructure 10, and $E_s$ is a modulus of the solid material portion of the microstructure 10. As such, the elastic modulus of a structure of embodiments of the present invention is also proportional to a geometric function of the angle $\theta$ of the structure, and $\theta$ can accordingly be chosen to vary (e.g., increase or reduce) the elastic modulus.

Figure 6:
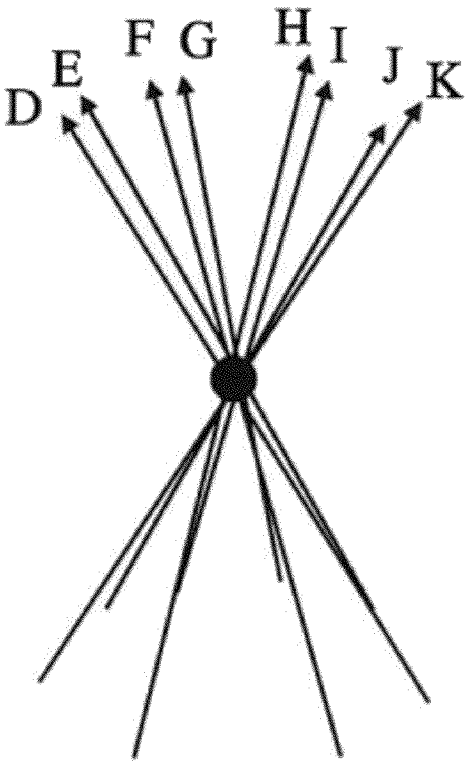
FIG. 6 is a perspective schematic view showing respective directions along which truss elements of a structure of an embodiment of the present invention extend.

With reference back to FIGS. 1 and 2, the microstructure 10 includes truss elements 12, 14, 16 respectively extending along A, B, and C directions. However, embodiments of the present invention are not limited thereto. For example, with reference to FIG. 6, a structure of an embodiment of the present invention may include truss elements defined by self-propagating polymer waveguides and extending along D, E, F, G, H, I, J and K directions, respectively. For example, a structure according to an embodiment of the present invention may include eight truss elements, each of which extends along a corresponding one of eight varying directions. Here, similar to the embodiment shown in FIGS. 1 and 2, the eight truss elements interpenetrate each to form nodes of a continuous material with a three-dimensional microstructure order. However, embodiments of the present invention are not limited thereto, and may include more or fewer than eight truss elements.

In a further embodiment of the present invention, an open volume of a cellular structure is filled at least partially with a material different from the material of the cellular structure itself, thereby creating an ordered bi-phase composite. Also in a further embodiment of the present invention, one or more truss elements of a cellular structure are coated with a material different from the material of the cellular structure itself to adjust the thermal behavior thereof. Also in a further embodiment of the present invention, base elements of a cellular structure are coated with a material different from the material of the cellular structural itself, and the base elements are removed to create a self-supporting structure having continuous but separated volumes.

The size scale and the features of structures of embodiments of the present invention can be utilized in heat transfer applications.

One embodiment of the present invention creates a three dimensional truss structure as described above. Here, the truss members are initially fabricated from a polymer and can vary anywhere between about 1 and about 500 (or between 1 and 500) microns in diameter. The angle, diameter, spacing and geometric architecture of the truss members can be suitably varied to create micro-truss structures with solid volume fractions between about 2 and about 90% (or between 2 and 90%).

The original polymer micro-truss structure is then modified for use in the manufacture of an armor according to an embodiment of the present invention. In this case, the term armor includes any material which exhibits suitable resistance (for a given weight or volume) to the following three attacks:

(1) breaching attempts made by high speed projectiles (bullets or shrapnel);

(2) drilling or grinding; and/or (3) directed energy/heat or thermal attacks.

As envisioned, in one embodiment, simultaneous (or concurrent) resistance to all three of these attacks would make the material useful in the construction of lightweight ballistic ("bullet proof") armor for mobile units (personnel, vehicles, and aircraft) as well as supplying additional security for immobile applications (safes and vaults).

In one embodiment, the armor is created by replacing (or modifying or converting) the as grown polymer micro-truss structure as shown in FIGS. 1 to 6 with a ceramic structure with the same or similar shape. For example, the structure depicted in FIG. 2 is only one possible configuration for the micro-truss, and the present invention is not thereby limited. In addition to the 4-fold symmetrical structure depicted in FIGS. 1 and 2, a micro-truss could be fabricated based on a unit cell with 3-fold, 6-fold, or any other symmetry capable of creating a repeating 3-dimensional pattern. Additionally, referring to FIGS. 7 and 8 and in embodiments of the present invention, the void space can either be partially or totally (completely) filled with a metal or tough (ductile) metal like material, forming a metal/ceramic composite. The inverse structure, i.e., a metallic truss with a ceramic filler, could be used for armor applications. While partial filling is not as strong as complete filling, it does preserve the porous nature of the truss, allowing for a breathable structure as shown in FIG. 9.

Figure 7:
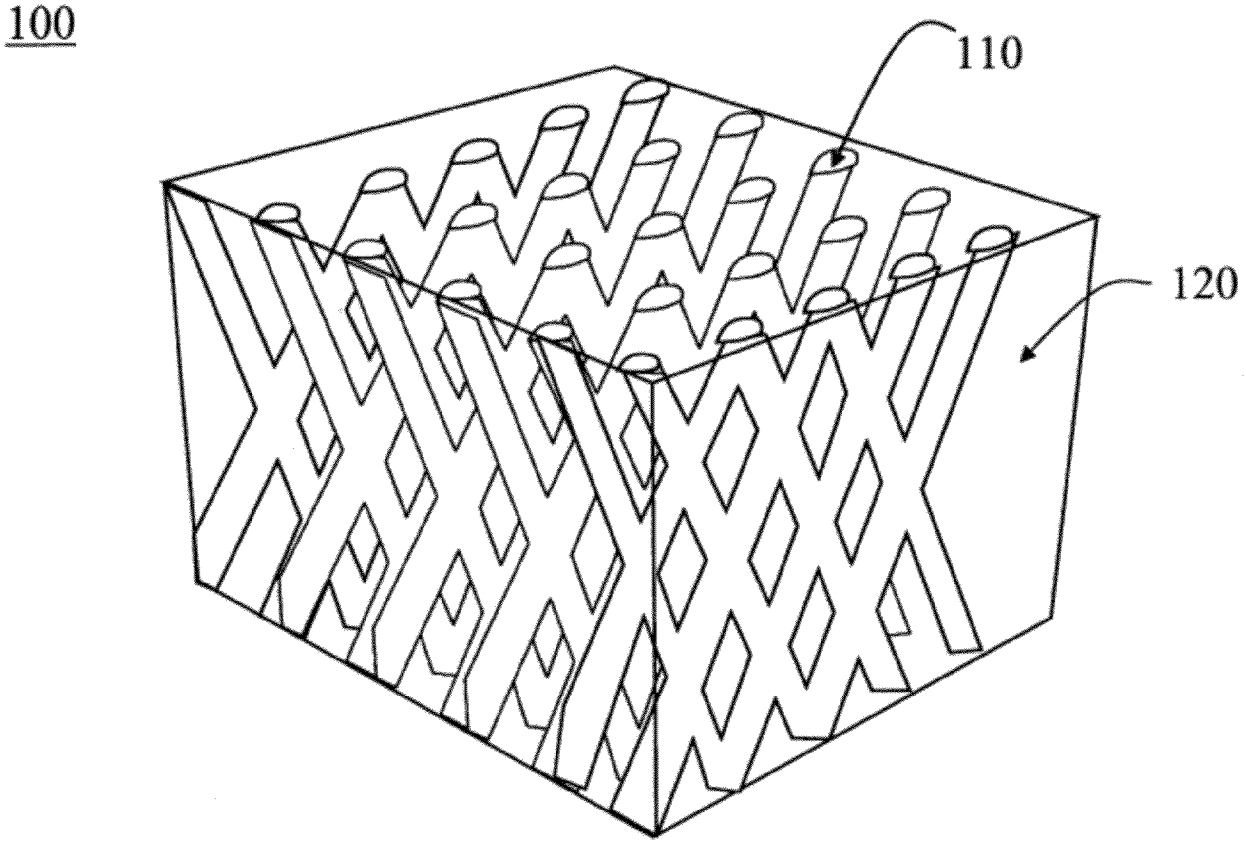
FIG. 7 schematically illustrates a ceramic/metal composite armor according to an embodiment of the present invention.

In more detail, FIG. 7 shows a ceramic/metal composite armor 100 based on the structure shown in FIGS. 1 and 2. In this particular embodiment, the armor 100 includes a three-dimensional structure (dark truss members) 110 and a tough (and/or strong) filler material 120. Here, in one embodiment, the three-dimensional structure 110 is formed by a ceramic material, and the tough filler material 120 is formed by a metal or similarly tough material.

In more detail, the three-dimensional structure 110 includes a plurality of truss elements (or members) defined by a plurality of first self-propagating polymer waveguides and extending along a first direction, a plurality of second truss elements defined by a plurality of second self-propagating polymer waveguides and extending along a second direction, and a plurality of third truss elements defined by a plurality of third self-propagating polymer waveguides and extending along a third direction. The first, second, and third truss elements interpenetrate each other at a plurality of nodes to form a continuous material. The first, second, and third truss elements define an open space. The tough filler material 120 occupies at least a portion of the open space, and the three-dimensional structure 110 is self-supporting. That is, the open (or void) space can either be partially or totally filled with the tough filler material 120 formed by a metal or tough (ductile) metal like material, thereby forming a metal/ceramic composite.

In one embodiment, the three-dimensional structure (or ordered truss structure) 110 is formed from a material selected from diamond like carbon (DLC), $B_6O$, BN, BCN, SiC, $Si_3N_4$ or any other similar high hardness and/or incompressible metal oxide, nitride, carbide, or boride (e.g. $Al_2O_3$, WC, TiN, $TiB_2$, $ReB_2$, etc.), or combinations thereof, and the filler material (or armor filler material) 120 is formed from a material selected from Al, Ti, Fe, Co, Ni, W, U, steel, and alloys thereof.

Alternatively, in another embodiment, the three-dimensional structure (or ordered truss structure) 110 is formed from a material selected Al, Ti, Fe, Co, Ni, W, U, steel, and alloys thereof, and the filler material (or armor filler material) 120 is formed from a material selected from the group consisting of diamond like carbon (DLC), $B_6O$, BN, BCN, SiC, $Si_3N_4$ or any other similar high hardness and/or incompressible metal oxide, nitride, carbide, or boride (e.g. $Al_2O_3$, WC, TiN, $TiB_2$, $ReB_2$, etc.), or combinations thereof.

Figure 8:
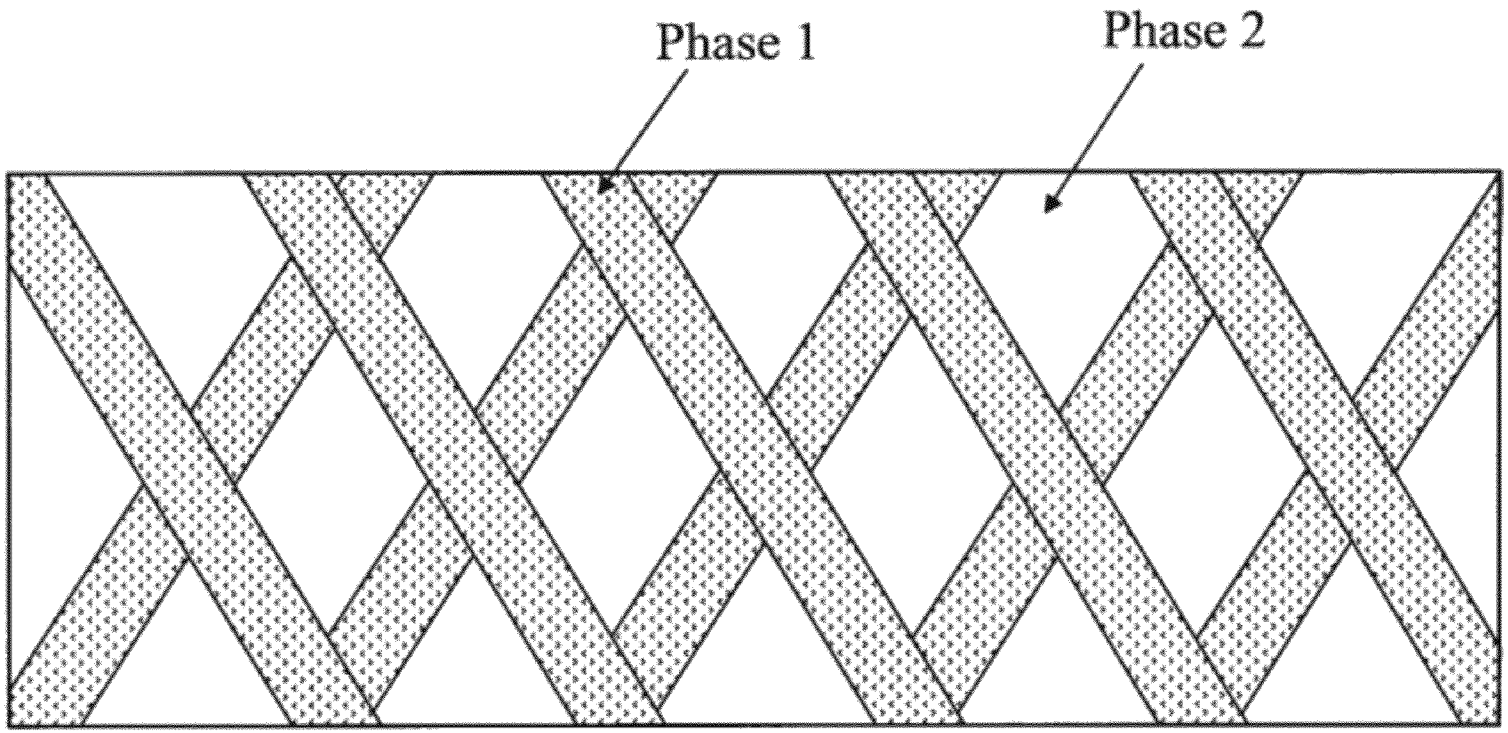
FIG. 8 is a cross sectional schematic view of an armor according to an embodiment of the present invention.
Figure 9:
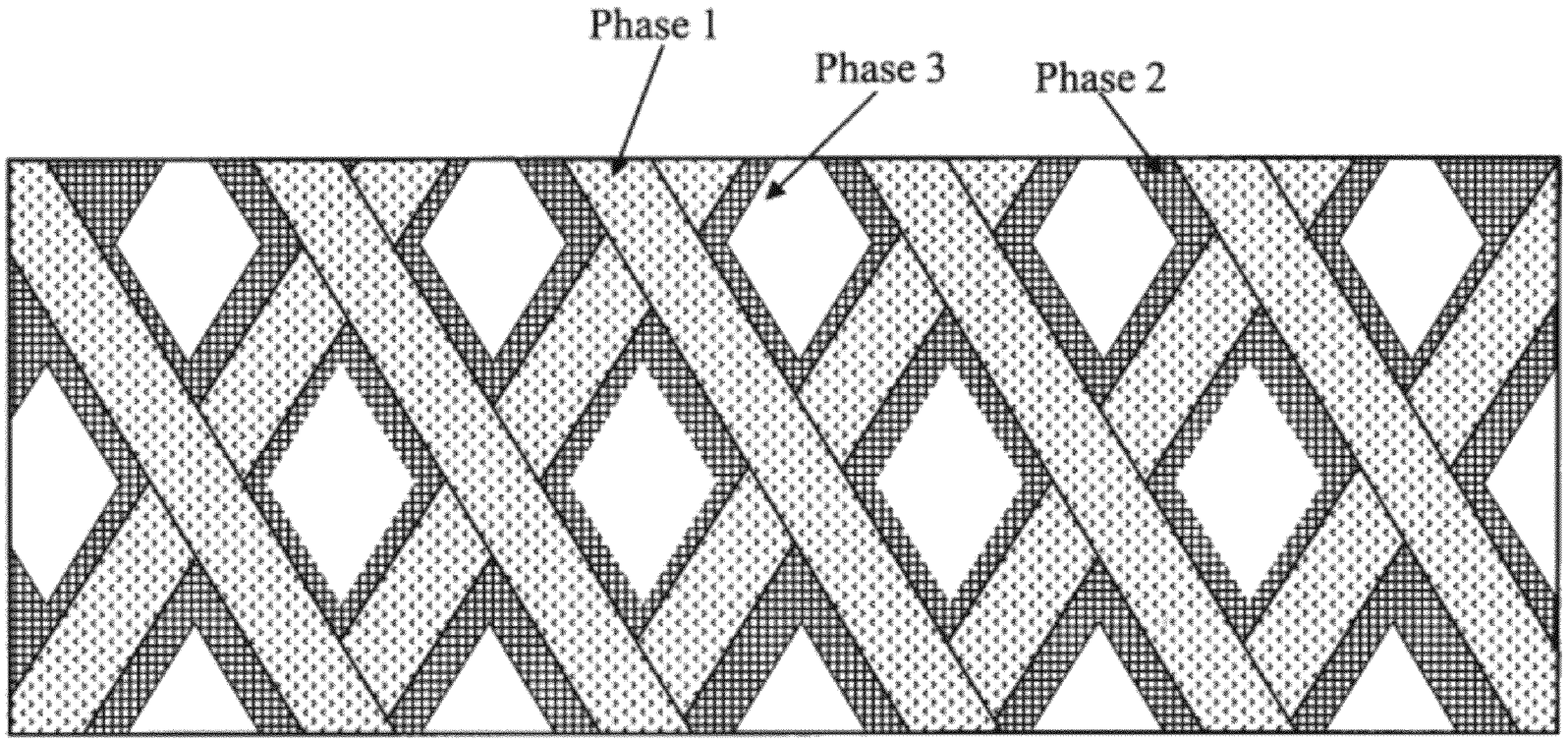
FIG. 9 is a cross section schematic view of an armor according to another embodiment of the present invention.

FIG. 8 is a cross sectional view of an armor according to an embodiment of the present invention. Similar to the embodiment shown in FIG. 7, the armor depicted in FIG. 8 includes the three-dimensional ceramic truss structure (Phase 1) and a metallic filler material (Phase 2).

FIG. 9 is a cross section view of an armor according to another embodiment of the present invention. As shown in FIG. 9, the armor includes a partially filled ceramic metal composite truss structure in which Phases 1 and 2 are either metal and ceramic, or ceramic and metal, respectively, and Phase 3 is unfilled empty space, which channels through the entire structure.

In one embodiment of the present invention, while the truss is still in its original polymer form as formed in FIG. 5, it is possible to shape or mold the polymer truss onto a template, after which the truss can be "frozen" in place by converting it into a ceramic truss or metal/ceramic composite. Potential mold shapes include car doors, breastplates, or any other shapes or structures which require armor protection.

Referring to FIGS. 8 and 9, while a wide variety of suitable ceramic materials could be used to fabricate the ceramic "Phase 1" of the armor composite, some of the more suitable choices according to embodiments of the present invention include diamond like carbon (DLC), $B_6O$, BN, BCN, SiC, $Si_3N_4$ or any other similar high hardness and/or incompressible metal oxide, nitride, carbide, or boride (e.g. $Al_2O_3$, WC, TiN, $TiB_2$, $ReB_2$, etc.), or combinations thereof. In one embodiment, SiC, TiC and/or $B_4C$ are used as the ceramic component in the composite armor plates due mostly to their exceptional hardness that improves their performance against ballistic threats. In another embodiment, DLC is used because it combines the highest hardness and the highest thermal conductivity (>1000 W/m·K) of any known ceramic material, thereby maximizing heat dissipation for improved resistance to thermal threats.

To improve the thermal conductivity of the armor according to one embodiment of the present invention, a polymer micro-truss structure formed according to FIG. 1 is electroless plated (e.g. plating with electroless Ni). The electroless plating process initially coats the polymer truss with a metallic film and, if continued for a long period of time, will completely fill the void space (Phase 2 of FIG. 8) with metal. At this point, the structure exists as polymer Phase 1 with a metallic Phase 2. The structure according to embodiments of the present invention is not limited by the use of electroless Ni. For example, other or additional metals can be utilized instead of Ni to electrolessly plate the truss or to fill the free space within the truss. For example, after depositing a thin layer of electroless metal (e.g. Ni), this first layer can serve as an electrically conductive "seed layer" for an electroplating process. A variety of electroplatable metals can then be deposited onto the seed layer, eventually filling Phase 2. In an alternative method, the polymer truss can be graphitized at high temperature, essentially creating an exact duplicate of the original structure, but composed entirely from carbon (graphite). The ability of graphite to withstand high temperatures allows for directly filling of the truss with liquid metals (i.e. casting). Upon achieving a structure with a completely metallic "Phase 2", the polymer (or graphite) micro-truss structure can be burned out at high temperatures, chemically removed, or dissolved away in a solvent. This leaves a structure resembling an "inverse metal truss" wherein the area 120 shown in FIG. 7 is made of metal, and the areas 110 (Phase 1) are empty space (air). At this point, the unoccupied space (Phase 1) can be back-filled with a variety of ceramic materials using a variety of processes, such as Chemical Vapor Deposition (CVD), Chemical Vapor Infiltration (CV1), Polymer Infiltration Process (PIP) with a pre-ceramic polymer followed by heating, and/or filling with a slurry of ceramic particles and sintering the structure. In another embodiment, the graphitic truss can be coated directly with a ceramic via a CVD/CV1 process. Following the CVD/CV1 process, the graphite can be removed by high temperature oxidation, after which liquid metal can be cast into the structure. This will also form a structure similar to the one shown in FIG. 9, where Phases 1 and 3 are metallic and Phase 2 is composed of ceramic tubes. In one embodiment, the armor is composed of a graphite/aluminum composite, wherein Phases 1 and 3 are a 5000 series aluminum-magnesium alloy, and Phase 2 is SiC.

As envisioned and according to embodiments of the present invention, regardless of the synthetic approach, the final product will resemble the structures depicted in FIGS. 7 and 8, wherein "Phase 1" is a ceramic and "Phase 2" is a metal, or the inverse structure, wherein "Phase 1" is a metal and "Phase 2" is the ceramic. Alternatively, the product may resemble the porous structure depicted in FIG. 9, which incorporates an additional empty or filled "Phase 3".

One of the main failure modes of traditional ceramic/metal laminate/composite armors involves ceramic to metal separation or extrusion. The ultra high metal-ceramic surface area combined with the continuously interconnected structure presented in embodiments of the present invention should minimize (or protect from) the possibility of either of these modes of failure. Additionally, due to the interwoven nature of the armor as discussed above with reference to FIGS. 8 and 9, should delamination take place, the ceramic component would still be physically held in place (trapped) by the surrounding metallic Phase 2. Therefore, any projectile attempting to pierce armor of this construction would be forced to move through a large amount of ceramic material.

Figure 10:
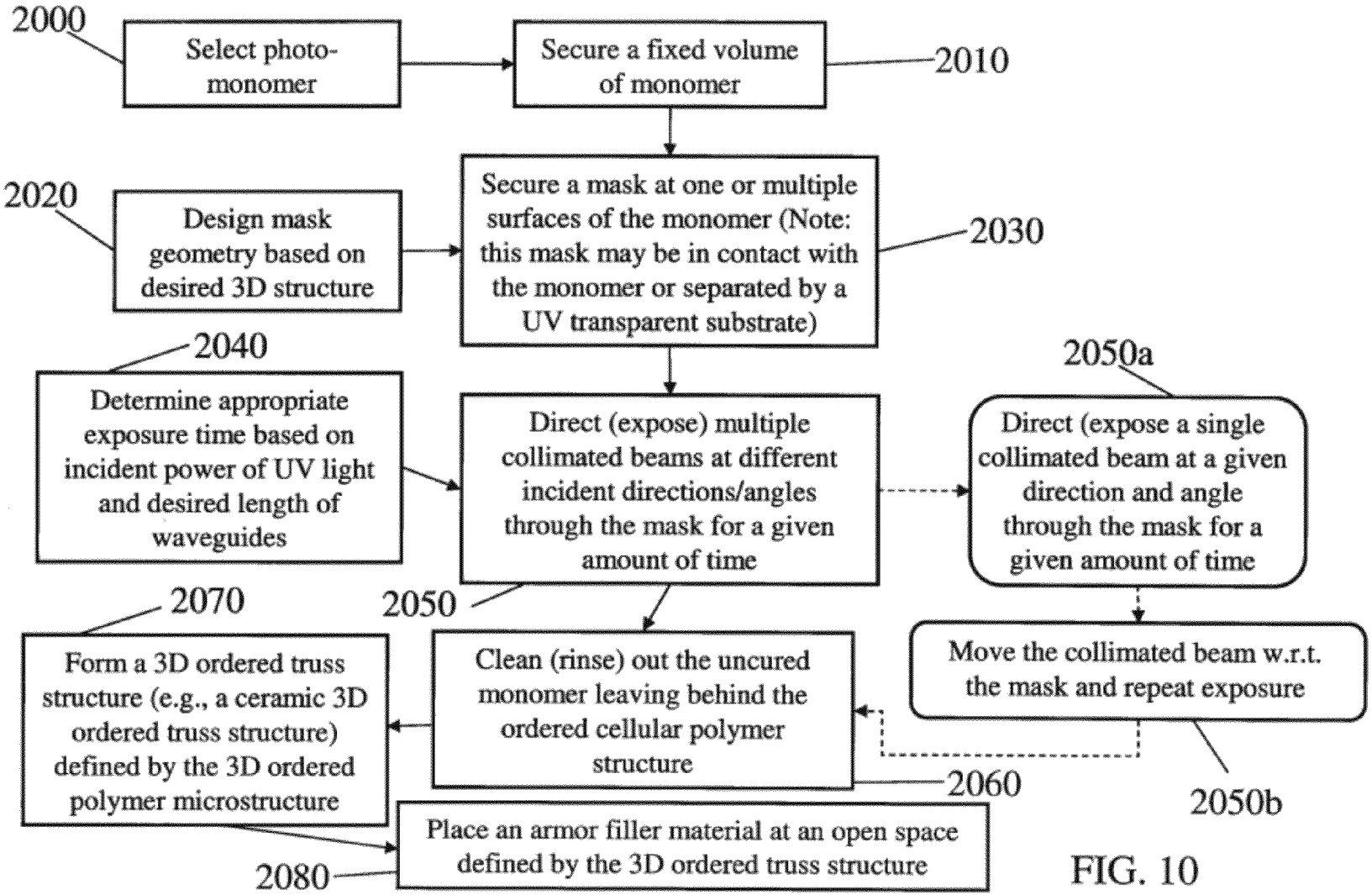
FIG. 10 is a process flow diagram for showing a method of forming an armor according to an embodiment of the present invention.

FIG. 10 shows a method of forming an armor according to an embodiment of the present invention. As illustrated in FIG. 10, a photo-monomer is selected in block 2000. In block 2010, a volume of the selected photo-monomer is secured (e.g., in a reservoir). A mask geometry is designed based on a desired 3D structure in block 2020. A patterning apparatus, such as a mask having the designed geometry, is secured in block 2030. Here, the secured mask has at least one aperture between at least one collimated light source and the volume of the selected photo-monomer. In addition, the mask may be in contact with the monomer or separated by a substrate (e.g., by a UV transparent substrate).

In block 2040, an appropriate exposure time is determined based on incident power of a collimated light beam from the at least one collimated light source (e.g., an incident power of a UV light) and a desired length of one or more waveguides. The collimated light beam from the at least one collimated light source is directed to the mask for a period of exposure time so that a portion of the collimated beam passes through the mask and is guided by the at least one aperture into the photo-monomer to form at least one waveguide through a portion of the volume of the photo-monomer. Here, the at least one waveguide has a cross sectional geometry substantially matching the designed aperture geometry on the mask.

In one embodiment as shown in block 2050, multiple collimated beams at different incident directions and/or angles are directed through the mask for a given amount of time.

Alternatively, as shown in blocks 2050*a*, a single collimated beam at a given direction and angle is directed through the mask for a given amount of time. Then, at block 2050*b*, the collimated light beam is moved with respect to the mask and the exposure is repeated.

At block 2060, any uncured photo-monomer is removed to leave behind a 3D ordered polymer microstructure. Here, in one embodiment, the plurality of polymer waveguides are used to form the 3D ordered polymer microstructure, and the 3D ordered polymer microstructure corresponds with the pattern of the plurality of apertures.

Then, at block 2070, a 3D ordered truss structure (e.g., a ceramic 3D ordered truss structure) is formed by the 3D ordered polymer microstructure. That is, a plurality of ceramic truss elements of the ceramic 3D ordered truss structure are defined by the plurality of polymer waveguides used to form the 3D ordered polymer microstructure.

Then, at block 2080, a tough armor filler material is placed at an open space defined by the ceramic truss elements of the 3D ordered ceramic microstructure.

Figure 11:
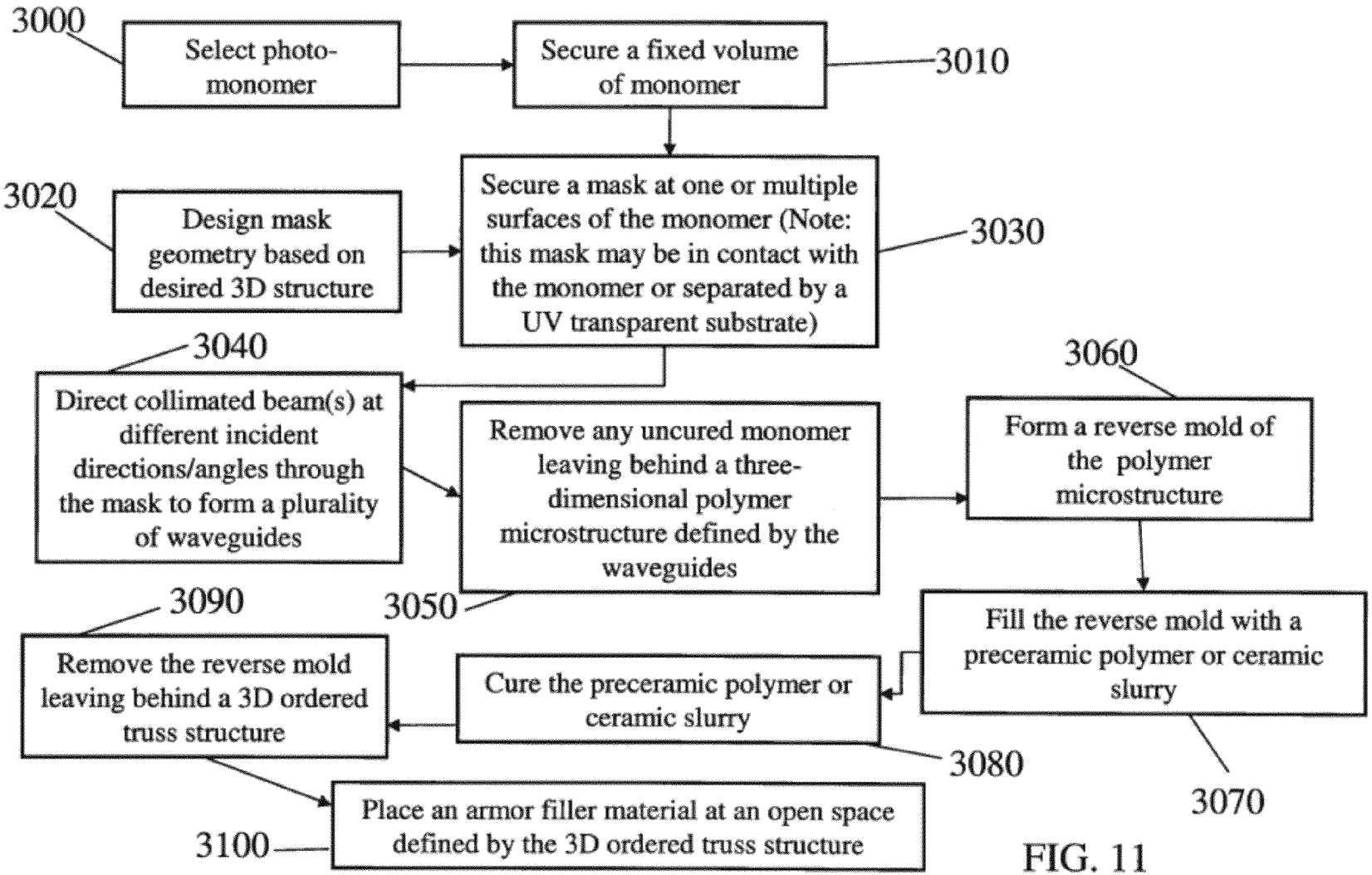
FIG. 11 is a process flow diagram for showing a method of forming an armor according to another embodiment of the present invention.

FIG. 11 shows a method of forming an armor according to an embodiment of the present invention. As illustrated in FIG. 10, a photo-monomer is selected in block 3000. In block 3010, a volume of the selected photo-monomer is secured (e.g., in a reservoir). A mask geometry is designed based on a desired 3D structure in block 3020. A patterning apparatus, such as a mask having the designed geometry, is secured in block 3030. Here, the secured mask has at least one aperture between at least one collimated light source and the volume of the selected photo-monomer. In addition, the mask may be in contact with the monomer or separated by a substrate (e.g., by a UV transparent substrate).

In block 3040, collimated beam(s) at different incident directions and/or angles are directed through the mask for a given amount of time to form a plurality of waveguides.

At block 3050, any uncured photo-monomer is removed to leave behind a 3D ordered polymer microstructure. Here, in one embodiment, the plurality of polymer waveguides are used to form the 3D ordered polymer microstructure, and the 3D ordered polymer microstructure corresponds with the pattern of the plurality of apertures.

At block 3060, a reverse mold of the polymer microstructure is formed, and the reverse mold is filled with a preceramic polymer or ceramic slurry.

At block 3080, the preceramic polymer or ceramic slurry is cured.

Then, at block 3090, the reverse mold is removed to leave behind the three-dimensional ordered ceramic microstructure having a plurality of ceramic truss elements.

Then, at block 3100, a tough armor filler material is placed at an open space defined by the ceramic truss elements of the 3D ordered ceramic microstructure.

In an alternative embodiment of the present invention, an armor structure can be created wherein the individual components are fabricated from the composite armor plates as shown in FIGS. 8 and 9. One such embodiment is shown below in FIG. 12, which describes a three (3) region structure, composed of an outer plate (Facesheet) Region 1, a truss-like inner structure (Core) Region 2, and a backing plate (Backing) Region 3. The facesheet, core, and/or backing plate Regions 1, 2, 3 can be made from either single component materials or from truss composites (as shown in FIGS. 8 and 9). Alternatively, the facesheets or other individual components could be laminate structures, composed of multiple sheets of micro-truss and/or metallic plates sandwiched together.

Figure 12:
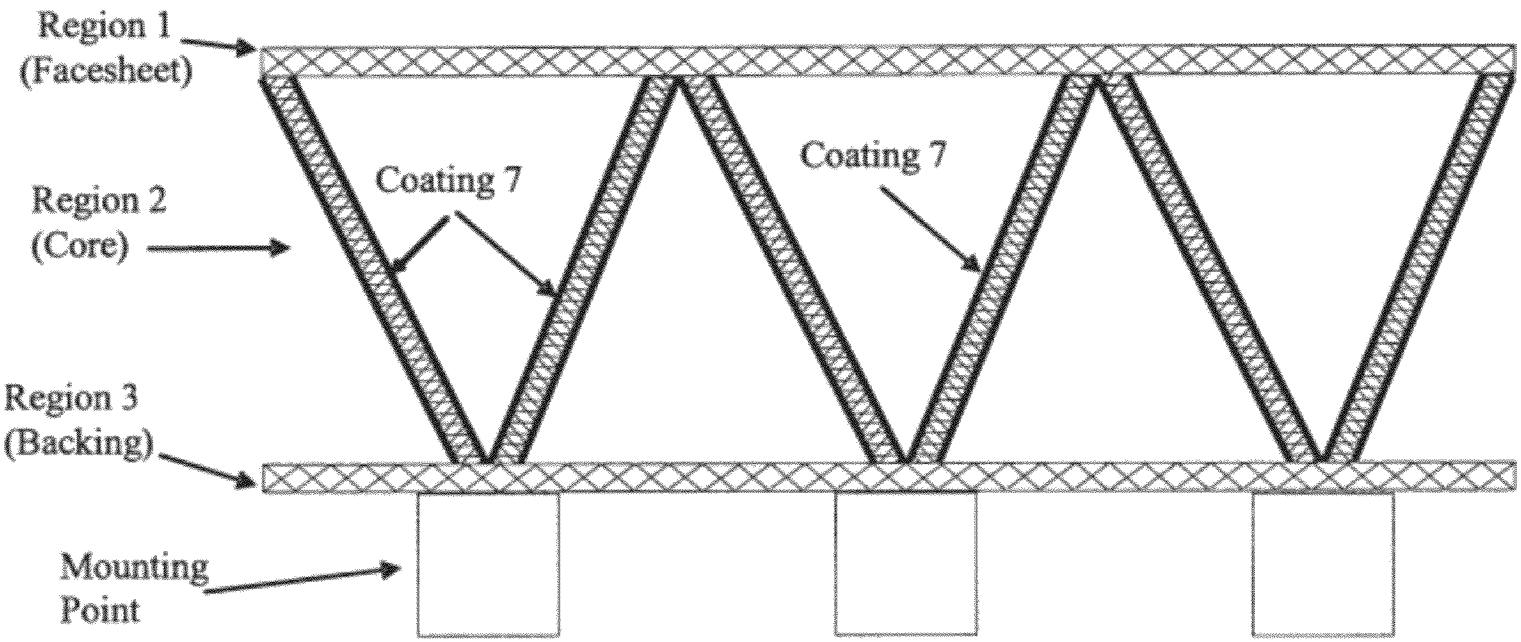
FIG. 12 schematically illustrates an alternative embodiment of the composite armor truss concept.

In more detail, FIG. 12 shows an alternative embodiment of the composite armor truss concept. In this embodiment, the armor is composed of a larger truss-like structure, wherein the individual plate components are themselves composite truss frameworks. The repeating "V" like structures (or V-shaped structures) of the larger truss core Region 2 in the sandwich has the potential to guide projectiles into specific desired locations, which can be reinforced with additional material. Projectiles could be guided into the black blocks (Mounting Points) shown at the bottom of FIG. 12, which could be the attachment points for mounting the armor plate to the vehicle's or aircraft's frame. All truss plates shown in FIG. 12 could potentially be asymmetrical, i.e. the faceplate (Facesheet) Region 1 on one side could be composed of a thicker or different material than the faceplate (Backing) Region 3 on the opposite side. That is, in one embodiment, the plurality of truss elements of the truss-like core are configured to guide the projectiles to the mounting blocks. Also, in one embodiment, a coating 7 is applied to the truss elements to enhance the guiding of the projectile. Here, as shown in FIG. 12, the core material in region 2 is the part covered with the coating 7 to guide projectiles. This coating 7 is the heavy dark line in FIG. 2, and, in one embodiment of the present invention is formed by steel.

In view of the foregoing, aspects of embodiments of the present invention are directed toward a micro-truss based composite armor (or composite truss armor) and a method and/or system of manufacturing the same. As examples, an embodiment of the present invention provides a type of armor plate composed of composite structure formed from a small scale truss network filled with a secondary (filler) material.

The truss can be completely filled to form a solid plate, maximizing performance against ballistic threats. In one embodiment, the truss is composed of a ceramic or ceramic-like material and the filler is a metal of metallic-like material. In one embodiment, the truss is composed of a metal of metallic-like material and the filler is a ceramic or ceramic-like material. In one embodiment, the truss is composed of graphitic carbon and is filled with metal and/or ceramic layers or regions. Some possible ceramics include but are not limited to SiC, TiC, $Si_3N_4$, diamond like carbon (DLC), $Al_2O_3$, $B_4C$. Some possible metals include but are not limited to aluminum alloys, titanium alloys, steel alloys, cobalt alloys, and nickel alloys.

The truss can be partially filled, forming a structure with interpenetrating pores which allow the plate to "breathe" and preventing (or reducing) heat and/or moisture build-up on the wearer. In one embodiment, the truss is composed of a ceramic or ceramic-like material, and the filler is a metal or metallic-like material. In one embodiment, the truss is composed of a metal or metallic-like material, and the filler is a ceramic or ceramic-like material. Some possible ceramics include but are not limited to SiC, TiC, $Si_3N_4$, diamond like carbon (DLC), $Al_2O_3$, $B_4C$. Some possible metals include but are not limited to aluminum alloys, titanium alloys, steel alloys, cobalt alloys, and nickel alloys.

The ceramic and/or metallic components of the armor can be chosen to maximize thermal conductivity throughout the structure. That is, armor with exceptional thermal conductivity would provide protection against thermal/heat based attacks.

The truss composite plates or rods can be arranged into a larger truss-like structure, providing additional benefits for defeating ballistic threats.

The truss armor according to an embodiment of the present invention has several applications, such as body armor (personnel), machinery armor (armored cars, tanks, planes, etc.), safe doors and vaults, and protection against thermal/heat based attacks.

Also, in view of the foregoing, the interpenetrating nature of the armor described in this disclosure and according to embodiments of the present invention provides three main enhancements over conventional ceramic composite armor. These enhancements are:

First, the truss framework is composed of a unified, ultra-hard (e.g., the hardness, such as Vickers Hardness (VH) of $Al_2O_3$, diamond, SiC, etc.), continuously interpenetrating phase of truss elements. Because many of the candidate materials for this phase also possess high thermal conductivity (e.g. $Al_2O_3$, diamond, SiC, etc.), the entire armor plate can act as a heat sink with exceptional thermal conductivity in 3-dimensions. This will minimize (or reduce) the formation of local hot spots during any attempt to breach the armor via a torch or any other heat/thermal attack. That is, the armor plates according to embodiments of the present invention can simultaneously (or concurrently) protect against thermal and ballistic threats.

Second, the 3-dimensional, interwoven nature of the ceramic phase within the metallic phase allows for a greater adherence (increased surface area) between the two phases compared to that which can be achieved using a 2-dimensional laminate structure. Thus, damage from an impact in one area of the armored plate may not cause the plate to break apart as there are no easy directions for crack propagation, which will allow the plate to defend against repeated threats. Additionally, a 3-dimensional network composite material can combine the toughness of a metal with the hardness/abrasion resistance of a ceramic to a higher degree than a traditional two-dimensional ceramic/metal laminate structure. This increased performance should allow for embodiments of the present invention to be formed into Level IV armor plates which are lighter and thinner than the laminate composite plates currently available. Additionally, damage from an impact in one area of the armored plate may not cause the plate to break apart as there are no easy directions for crack propagation.

Third, unlike layered composite armors which are optimized to defeat threats impinging at a specific angle (usually normal incidence) to the armor's surface, the symmetry of the 3-dimensional micro-truss structure provides nearly (or substantially) equal protection at all angles of threat incidence.

In addition, the armor according to an embodiment of the present invention can be designed to contain a continuous network of empty or air filled channels which will allow the armor to "breathe", preventing (or reducing) heat build up on the wearer or allowing moisture to escape.

Additionally, the exceptional hardness, toughness, and thermal conductivity of a 3-dimensional micro-truss based minor would also make it an ideal material for the construction of high-end safe doors and vaults in addition to armor for military personnel. Most vault doors are defeated either though drilling or torching through the door. The 3-dimensional ceramic micro-truss would be too hard to drill, and could conduct heat well enough to prevent any significant temperature build up from torch or heat exposure.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A composite truss armor comprising:

a filler material; and a three-dimensional ordered truss structure comprising:

a plurality of first truss elements defined by a plurality of first self-propagating polymer waveguides and extending along a first direction;

a plurality of second truss elements defined by a plurality of second self-propagating polymer waveguides and extending along a second direction; and a plurality of third truss elements defined by a plurality of third self-propagating polymer waveguides and extending along a third direction;

wherein the first, second and third ordered truss elements are coupled at a plurality of nodes unperturbed by changes in index of refraction caused by photopolymerization of the first, second and third self-propagating polymer waveguides and defined by waveguide intersections of the first, second and third self-propagating polymer waveguides;

wherein the first, second, and third ordered truss elements interpenetrate each other at the plurality of nodes to form a continuous material;

wherein the first, second, and third truss elements define an open space;

wherein the filler material occupies at least a portion of the open space; and wherein the three-dimensional ordered truss structure is self-supporting.

2. The composite truss armor of claim 1, wherein the three-dimensional ordered truss structure has a solid volume friction of not less than about 2% and not greater than about 90%.

3. The composite truss armor of claim 1, wherein the open space of the three-dimensional ordered truss structure is partially filled with the filler material such that the composite truss armor is a breathable structure.

4. The composite truss armor of claim 1, wherein the open space of the three-dimensional ordered truss structure is completely filled with the filler material such that the composite truss armor is a solid armor plate.

5. The composite truss armor of claim 1, wherein the three-dimensional ordered truss structure is a ceramic three-dimensional ordered truss structure, and wherein the filler material is a metallic filler material.

6. The composite truss armor of claim 1, wherein the three-dimensional ordered truss structure is a metallic three-dimensional ordered truss structure, and wherein the filler material is a ceramic filler material.

7. The composite truss armor of claim 1, wherein the three-dimensional ordered truss structure comprises a material selected from the group consisting of diamond like carbon (DLC), $B_6O$, BN, BCN, SiC, $Si_3N_4$, $Al_2O_3$, WC, TiN, $TiB_2$, $ReB_2$, and combinations and equivalents thereof, and wherein the filler material comprises a material selected from the group consisting of Al, Ti, Fe, Co, Ni, W, U, steel, and alloys thereof.

8. The composite truss armor of claim 1, wherein the three-dimensional ordered truss structure comprises a material selected from the group consisting of Al, Ti, Fe, Co, Ni, W, U, steel, and alloys thereof, and wherein the filler material comprises a material selected from the group consisting of diamond like carbon (DLC), $B_6O$, BN, BCN, SiC, $Si_3N_4$ $Al_2O_3$, WC, TiN, $TiB_2$, $ReB_2$, and combinations and equivalents thereof.

9. The composite truss armor of claim 1, wherein the three-dimensional ordered truss structure is a carbon three-dimensional ordered structure with one or more metal and/or ceramic layers coating a surface of at least one truss element of the first truss elements, the second truss elements, or the third truss elements.

10. The composite truss armor of claim 1, wherein the three-dimensional ordered truss structure and the filler material comprise ceramic and metallic material components for providing thermal conductivity throughout the composite truss armor to provide protection against thermal/directed energy/heat based attacks.

11. The composite truss armor of claim 1, wherein the three-dimensional ordered truss structure and the filler material are configured to be a personnel body armor, machinery armor, a safe door and/or vault armor, and/or a protection armor against thermal/directed energy/heat based attacks.

* * * * *